United States Patent [19]

Ubukata et al.

[11] Patent Number: 4,914,414

[45] Date of Patent: Apr. 3, 1990

[54] THERMALLY RESPONSIVE SWITCH

[75] Inventors: Susumu Ubukata, Kabushiki Kaisha Ubukata Seisakusho, 4-30, Hosei-cho, Minami-ku, Nagoya-shi, Aichi-ken; Yasukazu Mizutani, Nagoya, both of Japan

[73] Assignee: Susumu Ubukata, Nagoya, Japan

[21] Appl. No.: 388,855

[22] Filed: Aug. 3, 1989

[51] Int. Cl.[4] ..... H01H 37/12; H01H 61/08

[52] U.S. Cl. ..... 337/368; 337/89; 337/343

[58] Field of Search ..... 337/89, 94, 57, 365, 337/368, 343, 347

[56] References Cited

U.S. PATENT DOCUMENTS 3,431,526 3/1969 Ambler et al. ..... 337/89
3,538,478 11/1970 E'Entremont et al. ..... 337/89

FOREIGN PATENT DOCUMENTS 45-40818 12/1970 Japan .
49-24744 6/1974 Japan .

*Primary Examiner*—H. Broome
*Attorney, Agent, or Firm*—Foley & Lardner, Schwartz, Jeffery, Schwaab, Mack, Blumenthal & Evans

[57] ABSTRACT

A thermally responsive switch used in enclosed motor-compressors includes a supporter formed of a single metallic plate and including a support arm cantilever mounting a thermally responsive bimetallic or trimetallic element carrying a movable contact at one end, first and second beams disposed in a relation that the support arm is interposed between these beams, and an operative temperature calibration strip integrally extended from the first beam. The calibration strip is slidably inserted between the support arm and the second beam into a wedge structure in the state that the calibration strip is bent at the root portion. Consequently, when the calibration strip is bent with the slidable movement, the support arm is bent so that the contact pressure between the contacts is set, an amount of bending deformation of the support arm corresponding to an amount of bending deformation of the calibration strip.

4 Claims, 2 Drawing Sheets

THERMALLY RESPONSIVE SWITCH

BACKGROUND OF THE INVENTION

The present invention relates to a thermally responsive switch wherein a movable contact is engaged with and disengaged from a fixed contact by deforming a bimetallic or trimetallic thermally responsive element to thereby open and close an electric circuit, and more particularly to such a thermally responsive switch suitable for protection of electric motors of enclosed compressors used in refrigerators, room air conditioners and the like.

The thermally responsive switches of the above-described type are disclosed as "MINIATURE ELECTRICAL SWITCH" in Japanese Published Patent Application No. 45-40818 or as "MOTOR PROTECTOR AND METHOD OF MAKING THE SAME" in Japanese Published Patent Application No. 49-24744. However, these switches each have a problem of calibration of the switch to set an operative temperature of a thermally responsive element.

Generally, in the thermally responsive switches, a shallow dish shaped portion is formed in the central portion of the bimetallic thermally responsive element by way of drawing so that the same reverses its curvature by snap action in response to heat. In the solid state that the thermally responsive element undergoes no restrictive force at the free end, the thermally responsive element reverses its curvature by snap action at a predetermined temperature, for example, 140° C. and thereafter, recovers to the former state at a predetermined temperature, for example, 80° C. While, in the switch mechanism wherein the thermally responsive element is secured at one end to a stationary member and carries a movable contact at the other or free end and wherein the movable contact is engaged with a fixed contact secured to a stationary member, with a predetermined contact pressure at the normal temperature, the thermally responsive element is more liable to reverse its curvature as the contact pressure between movable and fixed contacts is increased. For example, where the thermally responsive element reverses its curvature by snap action at 140° C. in the above-mentioned solid state, the thermally responsive element reverses its curvature at 130° C. to thereby disengage the movable contact from the fixed contact when the contact pressure is increased, thereby obtaining an ideal thermally responsive switch in which the on-off operation thereof is instantaneously performed without any creeping. In the calibration of the thermally responsive switch, when the operative temperature of the thermally responsive element in the solid state or in the state that the movable contact undergoes no force imposed by the fixed contact to move it to the OFF position is in the range between 135° C. and 150° C. in accordance with a number of samples, the operative temperature at which the movable contact is disengaged from the fixed contact by snap action is adjusted to the range of 1305° C. ±5° C., for example. This work is referred to as an operative temperature calibration step. More specifically, in the operative temperature calibration step, either the member on which the fixed contact is secured or the member on which the fixed end of the thermally responsive element is secured is bent so that the contact pressure is impressed. Since the operative temperatures of the solid thermally responsive elements differ from one another, an amount of bending deformation differ from one thermally responsive element to another, which causes an amount of the so-called springback to differ from one thermally responsive switch to another. Consequently, the calibrated operative temperatures of the thermally responsive elements are rendered inaccurate.

SUMMARY OF THE INVENTION

Therefore, a primary object of the present invention is to provide a thermally responsive switch wherein the operative temperature thereof can be precisely set.

The thermally responsive switch of the present invention comprises first and second metallic members serving as two electrical terminals electrically insulated from each other, a fixed contact secured to the first metallic member, a support arm electrically conductively secured at one end to the second metallic member, and a thermally responsive element mounted on the other end of the second metallic member in cantilever relation. A movable contact is carried on the free end of the thermally responsive element. A dish-shaped portion is formed in a suitable portion of the thermally responsive element for a snap-acting reversing operation. The thermally responsive switch of the invention further comprises first and second metallic beam members held on a stationary member with the support arm interposed therebetween and a calibration strip substantially integral with the first beam member to be extended therefrom and having a portion where the same is bendable. The calibration strip is interposed between the support arm and the second beam member into a wedge structure so that the calibration strip is slidably adjacent to one side of the support arm and so that the free end thereof is slidably engaged with the second beam member, whereby the support arm undergoes the bending deformation, the amount of which deformation corresponds to that of the bending deformation of the calibration strip with slidable movement, such that the contact pressure between the movable and fixed contacts is set.

In one modified form, the support arm and the calibration strip are formed of a metallic plate integrally with the first beam member.

In another modified form, the first and second beam members, support arm and calibration strip are integrally formed of a single metallic plate.

According to the above-described thermally responsive switch, the calibration strip is interposed between the support arm and first beam member so as to form the wedge structure therewith. In this state of the calibration strip, the support arm is deformed in accordance with an amount of the bending of the calibration strip such that the contact pressure between the movable and fixed contacts is adjusted, thereby setting the operative temperature of the thermally responsive element at a predetermined value.

As the result that the calibration strip is interposed between the support arm and second beam member so as to form the wedge structure, a precise calibration of the thermally responsive switch to set the operative temperature of the thermally responsive element can be achieved since the amount of the bending of the calibration strip takes a large value relative to the slight bending deformation of the support arm. Additionally, the deviation of the set operative temperature due to the springback of the bent portion may be limited to the minimum value.

In further another modified form, a fixed contact arm has one end conductively secured to the first metallic member and the other end to which the fixed contact is secured. The fixed contact arm includes a first electrically conductive support piece to which the fixed contact is secured, a second electrically conductive support piece secured to the first metallic member, a ceramic or other insulator insulatively coupling the first and second conductive support pieces, and a conductive heating element provided along the insulator for electrically connecting the first and second support pieces.

According to the above-described thermally responsive switch, since the mechanical strength so much as to support the fixed contact is not required of the conductive heating element, the configuration thereof may be freely selected. Consequently, the range of the resistance value of the heating element may be rendered broader so as to cope with the value of an abnormal current to be expected.

Other and further objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

Two embodiments of the present invention will now be described with reference to the drawings.

Figure 1:
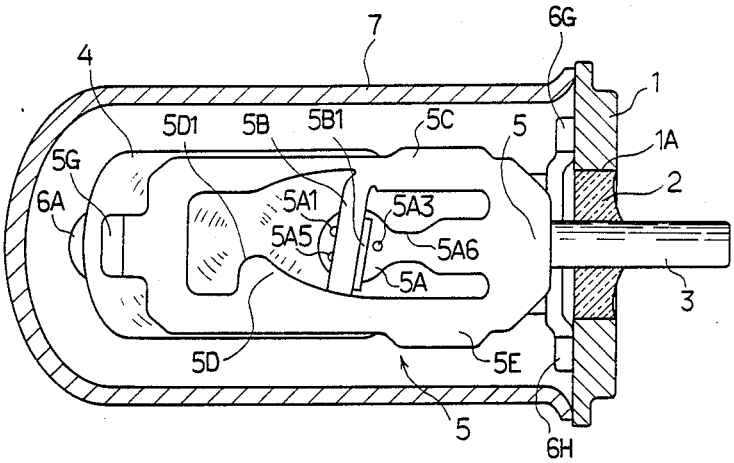
FIG. 1 is a transverse sectional view of a thermally responsive switch of a first embodiment of the invention.
Figure 2:
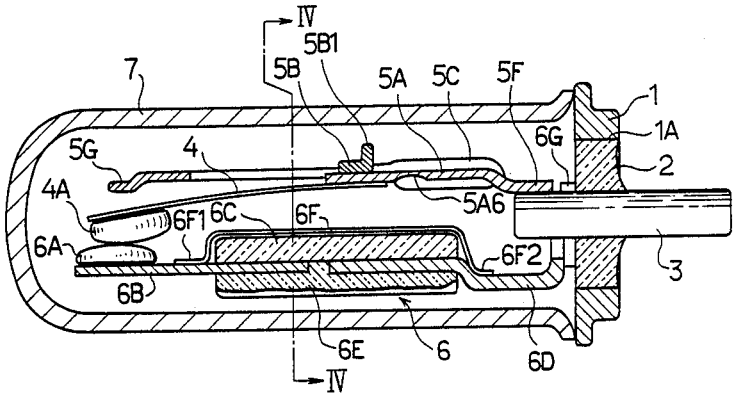
FIG. 2 is a longitudinal sectional view of the thermally responsive switch.
Figure 3:
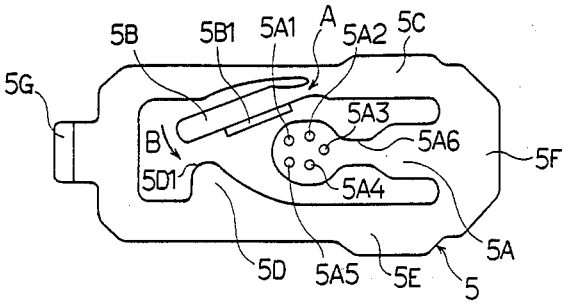
FIG. 3 is a top plan view of a supporter employed in the thermally responsive switch.
Figure 4:
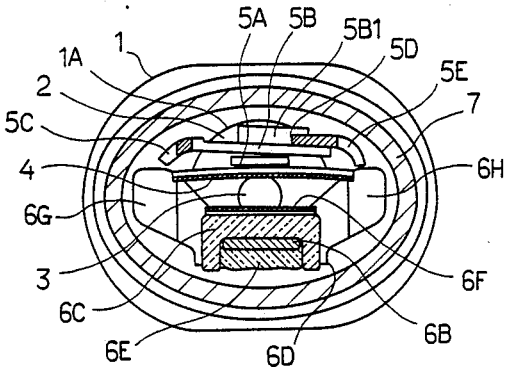
FIG. 4 is a sectional view taken along line IV—IV in FIG. 2.

Referring first to FIGS. 1 and 2, reference numeral 1 designates a generally elliptic header plate of a thermally responsive switch of one embodiment of the invention. The header plate 1 is formed of a relatively thick steel plate. A terminal pin 3 formed from an iron-nickel alloy is inserted through an central circular opening 1A formed in the header plate 1 and then secured therein by a hermetically sealing insulating material 2. A thermally responsive bimetallic element 4 is mounted on a support arm or support portion 5A in cantilever relation. A beam member 5C is provided with a calibration strip 5B. Another beam member 5E has a receiving section 5D for receiving the distal end of the calibration strip 5B. The beam members 5C and 5E are integral and secured at the root portion 5F to the left-hand end of the terminal pin 3, as viewed in FIGS. 1 and 2. In the embodiment, both ends of the respective beam members 5C and 5E are integral for the purpose of enhancing the mechanical strength of each beam member. Although the beam members 5C and 5E are integrally formed from a metallic plate in the embodiment, they may be formed independently and rendered integral by welding. For the purpose of description, the integral beam members 5C and 5E will hereafter be referred to as a supporter 5. The supporter 5 includes at the left-hand end a stopper portion 5G limiting a contact gap to a predetermined range in the case that the thermally responsive element 4 reverses its curvature with snap action at a predetermined temperature so that a movable contact 4A is disengaged from a fixed contact 6A. The fixed side or right-hand end of the thermally responsive element 4 is secured by spot welding to projections 5A1 to 5A5 (shown in FIGS. 1 and 3) downwardly embossed on the support arm 5A of the supporter 5. The movable contact 4A is secured to the free end of the thermally responsive element 4 by spot welding so as to engage and disengage from the fixed contact 6A. The fixed contact 6A is secured to one end of a metallic first support piece 6B by welding, which support piece 6B constitutes a fixed contact arm 6 with a second support piece 6D and a ceramic joint 6C serving as an insulator. The other end of the first support piece 6B is rigidly coupled to the ceramic joint 6C with one end of the second support piece 6D by a heat-proof adhesive 6E such as ceramics or glass having the fusing point a little lower than the joint 6C in electrically insulative relation to the second support piece 6D. The other end of the second support piece 6D is secured to the header plate 1 by spot welding through flanges 6G and 6H extended integrally from the same, as shown in FIG. 4. The second support piece 6D is electrically connected to the first support piece 6B having the fixed contact 6A through a heating conductor 6F as a heating element having selected values of respective natural resistance, sectional area and length thereof. More specifically, the heating conductor 6F is disposed along the joint 6C and the left-hand end 6F1 thereof is connected to the first support piece 6B by spot welding with the right-hand end 6F2 conductively connected to the second support piece 6D in the same manner. Particularly, when it is necessary to operate the thermally responsive element 4 with a small amount of electric current, the resistance value of the heating conductor 6F is required to be increased. However, the same effect can be achieved by affixing a metallic film or carbon film on the joint 6C to thereby form the heating conductor. Since the fixed contact arm 6 is constituted by the ceramic joint 6C and the first and second support pieces 6B and 6D secured to the joint 6C by the heat-proof adhesive 6E with sufficient mechanical strength, the mechanical strength required of the heating conductor 6F is sufficient to prevent the same from being disconnected from the joint 6C or deformed. Consequently, the resistance value of the heating conductor 6F may be selected from a broad range so as to cope with a locked-rotor current flowing in a motor circuit to which the thermally responsive switch is connected, in the abnormal condition.

In each of FIGS. 1 and 2, positions of the calibration strip 5B and the support arm 5A show that the thermally responsive switch has been calibrated so as to take a predetermined operative temperature. The position of the calibration strip 5B in FIG. 3 shows the condition of the thermally responsive switch before such a calibration. Comparison of FIGS. 3 and 4 will help understand the manner of calibrating the thermally responsive switch. In order that the calibration strip 5B is bent in the counterclockwise direction or in the direction of arrow B in FIG. 3 about the vicinity of the root portion thereof shown by arrow A, the calibration strip 5B is provided with a flange 5B1 upwardly raised at a right angle therewith and extending along the elongation thereof. The calibration of the switch can be performed with ease by bending the calibration strip 5B about the portion A with a screwdriver-like calibration tool having a groove into which the flange 5B1 can be inserted. It is preferable that the portion A of the calibration strip 5B should have a deformable sectional configuration. In a preferable configuration of the portion A, the portion A has the thickness and width smaller than the both side adjacent portions, as shown in FIG. 2. For the purpose of ensuring the calibration, the portion of the supporter 5 where the first beam member 5C is opposed to the receiving portion 5D of the second beam member 5E with the support arm 5A interposed therebetween is slightly stepped and the receiving portion 5D is inclined in the manner that the underside thereof approaches the plane of the supporter 5 as it goes from one end 5D1 where the calibration strip 5B invades the underside area of the receiving portion 5D, toward the opposed end thereof. As the calibration strip 5B is bent in the direction of arrow B, the distal end of the calibration strip 5B invades the underside area of the receiving portion 5D gently inclined and the central portion thereof where the flange 5B1 is formed slides on the support arm 5A, thereby bending the support arm 5A at portion 5A6 having deformable sectional configuration in the direction perpendicular to the plane thereof. Consequently, the thermally responsive element 4 secured to the support arm 5A is caused to be pushed in the direction that the left-hand end thereof is lowered, thereby increasing the contact pressure between the movable and fixed contacts 4A and 6A. The contact pressure between the contacts 4A and 6A is increased with increase of an amount of bending deformation of the calibration strip 5B in the direction of arrow B, depending on the inclination of the receiving portion 5D relative to the support arm 5A, thereby lowering the operative temperature of the thermally responsive element 4.

After completion of the above-described calibration work, all the components are enclosed in a metallic switch case or housing 7 and the open end thereof is then secured to the header plate 1, thereby hermetically sealing the case 7.

The above-described thermally responsive switch is characterized in that the calibration strip 5B is interposed between the support arm 5A to which the thermally responsive element 4 is secured and the receiving portion 5D so as to provide a wedge structure with them. In such construction, since the calibration strip 5B necessitates a large amount of bending deformation while the support arm 5A necessitates a small amount of bending deformation, the thermally responsive switch may be calibrated so that the operative temperature of the thermally responsive element 4 can be precisely set. Additionally, deviation of the set operative temperature due to the springback can be rendered so small as to be ignored.

Figure 5:
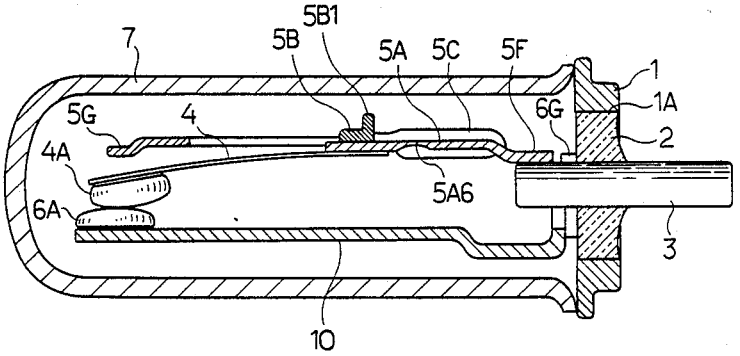
FIG. 5 is a view similar to FIG. 2 showing a thermally responsive switch of a second embodiment.

FIG. 5 illustrates a second embodiment of the invention. In the second embodiment, a fixed contact arm 10 is formed of a conductor which generates heat when a large current flows therethrough.

The foregoing disclosure and drawings are merely illustrative of the principles of the present invention and are not to be interpreted in a limiting sense. The only limitation is to be determined from the scope of the appended claims.

What we claim is:

1. A thermally responsive switch comprising:

(a) first and second metallic members serving as two electrical terminals electrically insulated from each other;

(b) a fixed contact secured to the first metallic member;

(c) a support arm electrically conductively secured at one end thereof to the second metallic member;

(d) a thermally responsive element mounted on the other end of the second metallic member in cantilever relation, the thermally responsive element having a free end on which a movable contact is carried and a dish-shaped portion formed in a suitable portion thereof for a snap-acting reversing operation;

(e) first and second metallic beam members held on a suitable stationary member with the support arm interposed therebetween; and (f) a calibration strip substantially integral with the first beam member to be extended therefrom and having a portion where the same is bendable, the calibration strip being interposed between the support arm and the second beam member into a wedge structure so that the calibration strip is slidably adjacent to one side of the support arm and so that the free end thereof is slidably engaged with the second beam member, whereby the support arm undergoes the bending deformation, the amount of which deformation corresponds to that of the bending deformation of the calibration strip with slidable movement, such that the contact pressure between the movable and fixed contacts are set.

2. A thermally responsive switch according to claim 1, wherein the support arm and calibration strip are formed of a single metallic plate integrally with the first beam member.

3. A thermally responsive switch according to claim 2, wherein the first and second beam members are integrally formed of a metallic plate.

4. A thermally responsive switch comprising:

(a) first and second metallic members serving as two electrical terminals electrically insulated from each other;

(b) a fixed contact arm having one end electrically conductively secured to the first metallic member and the other end to which a fixed contact is secured, the fixed contact arm including a first electrically conductive support piece to which the fixed contact is secured, a second electrically conductive support piece secured to the first metallic member, a ceramic or other insulator insulatively coupling the first and second support pieces, and a conductive heating element provided along the insulator for electrically connecting the first and second support pieces;

(c) a support arm electrically conductively secured at one end thereof to the second metallic member;

(d) a thermally responsive element mounted on the other end of the second metallic member in cantilever relation, the thermally responsive element having a free end on which a movable contact is carried and a dish-shaped portion formed in a suitable portion thereof for a snap-acting reversing operation;

(e) first and second beam members held on a suitable stationary member with the support arm interposed therebetween; and (f) a calibration strip substantially integral with the first beam member to be extended therefrom and having a portion where the same is bendable, the calibration strip being interposed between the support arm and the second beam member into a wedge structure so that the calibration strip is slidably adjacent to one side of the support arm and so that the free end thereof is slidably engaged with the second beam member, whereby the support arm suffers the bending deformation, the amount of which deformation corresponds to that of the bending deformation of the calibration strip with slidable movement, such that the contact pressure between the movable and fixed contacts are set.

* * * * *